United States Patent [19]

Lehmann et al.

[11] Patent Number: 4,585,219

[45] Date of Patent: Apr. 29, 1986

[54] SERIES FEEDING DEVICE FOR A FOLDING MACHINE

[75] Inventors: Werner Lehmann, Gutach; Rainer Fecker, Furtwangen; Manfred Fuss, St. Georgen, all of Fed. Rep. of Germany

[73] Assignee: Mathias Bäuerle GmbH, Fed. Rep. of Germany

[21] Appl. No.: 750,696

[22] Filed: Jun. 28, 1985

[30] Foreign Application Priority Data

Jul. 10, 1984 [DE] Fed. Rep. of Germany ..... 3425302

[51] Int. Cl.[4] ..... B42C 1/00; B65H 45/20

[52] U.S. Cl. ..... 270/46; 493/405; 493/419

[58] Field of Search ..... 270/46; 493/416–417, 493/419–420, 423, 405, 441

[56] References Cited

U.S. PATENT DOCUMENTS

| | | | |
|---|---|---|---|
| 1,048,996 | 12/1912 | Nino et al. | 493/416 |
| 1,898,794 | 2/1933 | Spiess | 493/416 |
| 3,711,085 | 1/1973 | Bunch, Jr. | 493/419 |

FOREIGN PATENT DOCUMENTS

| | | | |
|---|---|---|---|
| 115548 | 9/1980 | Japan | 493/417 |
| 168309 | 8/1959 | Sweden | 493/420 |
| 234126 | 3/1926 | United Kingdom | 493/420 |
| 476519 | 12/1937 | United Kingdom | 493/416 |

*Primary Examiner*—E. H. Eickholt

*Attorney, Agent, or Firm*—McGlew and Tuttle

[57] ABSTRACT

A folding machine includes an entrance feed for the infeed of materials to be folded which are operated on by a plurality of folding devices arranged along the feed path, each of which feeds the material after folding into a receiving pocket which has an adjustable stop. The stop is adjusted so that the materials being fed are received in the pocket at the correct location so as to position them for subsequent folding or for ejecting at an ejection point. The invention provides a conveyor belt which operates so that an upper transport reach is movable below the ejection point to receive the folded materials. Associated with the conveyor is a brake element which overlies the materials which are fed on the conveyor transport reach. The brake element rests on the folding material and is mounted so that it applies a yieldable pressure on the materials as they moved therealong. A flexible member is connected between the brake element and the adjustable stop of the last folding pocket so that the position of the brake element can be adjusted relative to the ejection point by the same amount that the adjustable stop is adjusted in respect to its associated pocket.

11 Claims, 7 Drawing Figures

SERIES FEEDING DEVICE FOR A FOLDING MACHINE

FIELD AND BACKGROUND OF THE INVENTION

This invention relates in general to folding machines and in particular to a new and useful folding machine having improved adjustable means for feeding the folded materials in a series.

The invention relates to an upset folding machine with several folding pockets, each having an adjustable paper stop, and with a conveyor to seriate like scales the material leaving the folding device, the conveyor having at least one endless conveyor belt whose upper stringer runs in a transport path disposed below a folded material ejection point of the folding device and is driven in an operating direction at a speed slower than corresponds to the ejections speed, and there being provided at least one brake element which rests vertically movable under spring pressure and/or by gravity on the upper conveyor belt stringer, or on the folded material covering the conveyor belt stringer, and is fastened to a holder so as to be adjustable with the holder parallel to the transport path to different distances from the folded material ejection point.

In one known upset folding machine of this kind (German Patent Application No. P 34 12 606.6-27) the conveyor has several conveyor belts which run parallel to each other, are driven by one common drive shaft and are disposed in an inclined plane below the ejection roller pair. The upper stringers of the conveyor belts run across a common, tablelike guide plate serving as a supporting base. Two brake discs are mounted on a common shaft extending transverse to the conveyor belts. By means of a clip the shaft is fastened to a rod extending parallel to the conveyor belts and is adjustable in the rod's longitudinal direction so that their distance from the ejection rollers can be set according to the respective format of the folded material. However, this setting must be made manually by means of a knurled screw which can clamp the clip in which the shaft is mounted to the rod in the desired position.

Also, there are already conveyors having only two conveyor belts and conveyors using no brake discs as brake elements, but flat spiral springs or nonrotating brake pads or balls.

The disadvantage of these known conveyors is that their brake elements must be brought manually into a new position in which their distance from the ejection point is in accordance with the final format of the folded material whenever this final format changes. This disadvantage becomes noticeable particularly when folding machines are involved which should be operable by untrained personnel because, if the distance of the brake elements from the ejection point of the folding machine is set wrongly, especially at high operating speeds, breakdowns may occur in the conveyor area, for instance in that the folded material leaving the folding device is ejected uncontrolled and is not picked up by the conveyor at all, or in that jams and unwanted accumulations and stacking occurs ahead of the braking device.

SUMMARY OF THE INVENTION

It is an object of the invention to avoid the disadvantage described and to provide an upset folding machine with a conveyor whose brake elements are automatically set to the proper distance from the ejection point when setting the machine to the final folded format. According to the invention, the brake element holder is connected by a flexible pulling member to the paper stop of the folding pocket disposed immediately ahead of the folded material ejection point and, by virtue of its adjustment to the final folded material format, is adjustable to the distance from the folded material format.

The special advantage achieved thereby is that wrong brake element adjustments and, hence, breakdowns caused thereby are prevented with certainty without the operator having to pay special attention thereto or having to perform any special manipulations.

In this connection, it is of advantage if the pulling member is guided between the paper stop and the brake element holder in such a manner that a pulling force exerted by the pulling member on the holder is opposed to the ejection direction of the folded material or the conveyor belt transport direction. While the possibility exists to see to it that by providing a second pulling member or a spring, the holder with the brake element or elements follows the paper stop adjusting motions in both directions, the arrangement wherein the pulling member is guided between the paper stop and the holder of the brake element so that a pulling force exerted by the pulling member on the holder is directed opposite to the folded material ejection direction or to the transport direction of the conveyor belt, obviates a second pulling member and also a spring because the trailing motion of the holder in the transport direction of the conveyor belt or belts can be effected by the friction between the conveyor belt or belts and the brake element or elements.

Another advantageous embodiment of the invention is that the holder has a flat part disposed below the upper conveyor belt stringer and extending over the entire transport path width, said flat part being provided at both ends with vertical supporting elements which jointly support over the transport path a shaft or a cross beam to which or on which at least one brake element is fastened.

It is already known from the state of the art that usually two brake elements spaced a certain transverse distance apart are used. But is is also imaginable that only a single brake element of adequate width could work just as well functionally.

The embodiment of the invention is that the holder has a flat part, which is disposed below the upper conveyor belt stringer, extends over the entire width of the conveyor belt, and is provided at both ends with vertical support elements which jointly support over the transport path a shaft or a cross beam to which at least one brake element is fastened which creates for the upper conveyor belt stringer or stringers or for the brake element or elements loosely resting on these conveyor belt stringers by spring pressure or by their own weight a supporting surface which makes it possible to do without the known fixed table-like plate. Beyond this, it brings with it the further advantage that an increased friction between the conveyor belt or belts and the holder is achieved which takes care that the pulling member is kept taut, constantly during operation thereby maintaining the set distance between the braking device and the ejection point.

One very simple holder arrangement, particularly from the aspect of production engineering, results from the flat part of the holder being disposed directly under the upper conveyor belt stringer and mounted in two parallel guide rails.

In further development of the invention it is provided in an upset folding machine in which the conveyor is disposed on the folding device side opposite the folding pocket which determines the folded material format that one end of the flexible pulling member consisting of a string, a rope, a chain or a wire is fastened directly to the paper stop and its other end directly to the holder below the transport path and led over an idler pulley located at the outer end of the folding pocket. This makes possible in simple manner the required adjustment between the paper stop and the holding devoce.

There are also folding machines in which the conveyor and the folding pocket determining the final folded material format are disposed on the same side of the folding device. In such a case, of course, the reorientation of the pulling member is unnecessary, rather, a direct, straight connection between the paper stop and the holding device may there be provided, which may be rigid or flexible.

Another embodiment of the invention is characterized in that the conveyor has two brake elements comprising cylindrical dics of the same diameter, disposed with mutual spacing on a shaft rotatably mounted in the supporting elements of the holder, the outside diameters of the discs being provided with friction coatings. With such an arrangement a uniform and straight transport of the folded material on the conveyor belt or belts can be achieved by simple means. It is also possible to fix the two discs so as to corotate with the shaft.

However, in a more advantageous embodiment of the invention the discs each have hub bores with annular slots in which are accommodated friction elements, e.g. in the form of rubber O-rings forming a friction clutch between the discs on the one hand and the shaft on the other while making it possible to move the discs on the shaft.

This embodiment assures not only that the discs are movable on the shaft, it also offers the advantage of a very simple and cost effective assembly of the discs on the shaft and their positioning, small friction moments already being sufficient to assure synchronism of the two discs and the shaft.

Accordingly it is an object of the invention to provide an improved means which operates with a folding machine which has one or more receiving pockets into which material being folded are directed which have adjustable stops which may be adjusted for delivering the article through a folding device to an ejection point and which includes a conveyor for conducting the materials away from the ejection point having a braking element which is movable in accordance with the adjustment of the stop on the receiving pocket of the folding machine.

A further object of the invention is to provide an improved adjustment device for feeding folded articles in series.

A further object of the invention is to provide a folding machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which perferred embodiments of the invention are illustrated.

DESCRIPTION OF THE PREFERRED EMBODIMENTS

Figure 2:
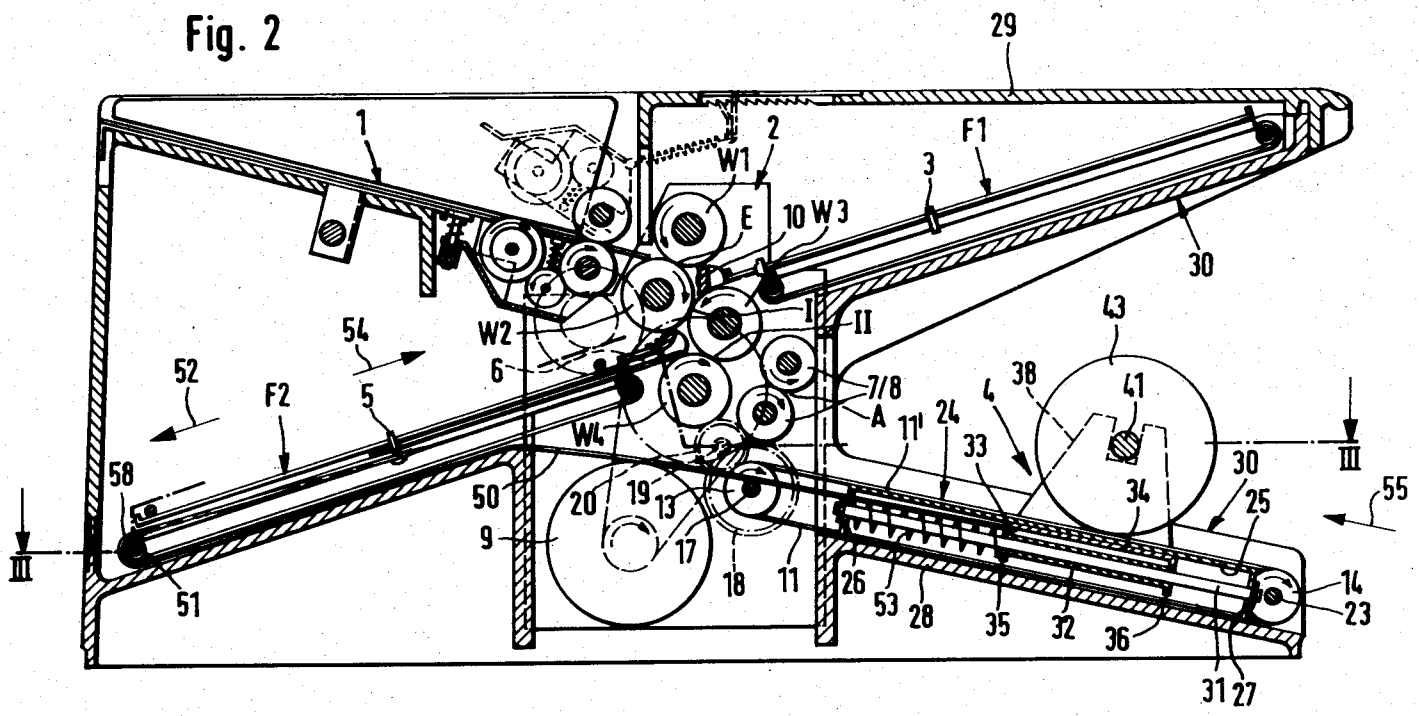
FIG. 2 is a longitudinal sectional view of the upset folding machine of FIG. 1.

Referring to the drawings in particular the invention embodied therein comprises a folding machine for folding a plurality of materials which as best shown in FIG. 2 includes an entrance feed 1 for delivering the materials in succession to a folding apparatus generally designated 2 which has one or more receiving pockets F1 which are arranged in association with folding means such as rollers which deliver the folded materials through an ejection point A for further feeding through a transport path generally designated 4 so that the articles are separated in a series feed. In accordance with the invention, the conveyor belt 11 or 12 having a transport reach movable below the ejection point A in a position to receive the folded materials. Associated with the conveyor belt is at least one brake element 42,43 which overlies the conveyor element transport path 24 and rests on the folded materials which move over the transport path. Mounting means including a plate 25 or the support 34 are associated with the braking elements 42 and 43 so that the elements 42 and 43 apply a yieldable pressure on the materials as they are moved through the transport path 24 on the conveyors 11 or 12. The feature of the inventive arrangement is that a member 50 is connected to the mounting means for the brake elements 42 and 43 and also to the adjustable setting stop 5 of a last pocket F1 adjacent the ejection point A. The member 50 is adapted to move the braking elements 42 and 43 relative to the ejection point by an amount equivalent to the movement of the stop 5.

The embodiment of the invention depicted in FIGS. 1 through 3 involves an upset folding machine with a feed table 1, a roll system 2, and two folding pockets F1 and F2, as well as with a conveyor 4 disposed below the first folding pocket F1. The roll system 2 contains a total of four rolls W1, W2, W3, W4 running parallel to each other and arranged so that the rolls W1 and W2 form a pull-in point or entrance point E, the rolls W2 and W3 a first folding point I and the rolls W3 and W4 a second folding point II. Directly behind the pull-in point E is the inlet opening 3' of the folding pocket F1 whose paper stop 3 is disposed on the side of the roll system 2 located opposite the feed table 1. Located below the feed table 1, in at least approximately the same inclination as the folding pocket F1, is the folding pocket F2 with its paper stop 5 whose inlet opening 6 is disposed between the two folding points I and II. As viewed in the travel direction through the roll system 2, there is behind the folding point II an ejection roll pair 7/8 which forms the ejection point A. The roll system 2 is driven by an electric motor 9.

Between the pull-in point E and the first folding point I is a paper director 10 which can be pivoted from the position shown in FIG. 2 in which it closes the inlet opening 3' of the folding pocket F1 and directs the folding material arriving from the pull-in point E directly to the folding point I into a position in which it does not hinder the folding material arriving from the pull-in point E from running into the folding pocket F1.

Figure 1:
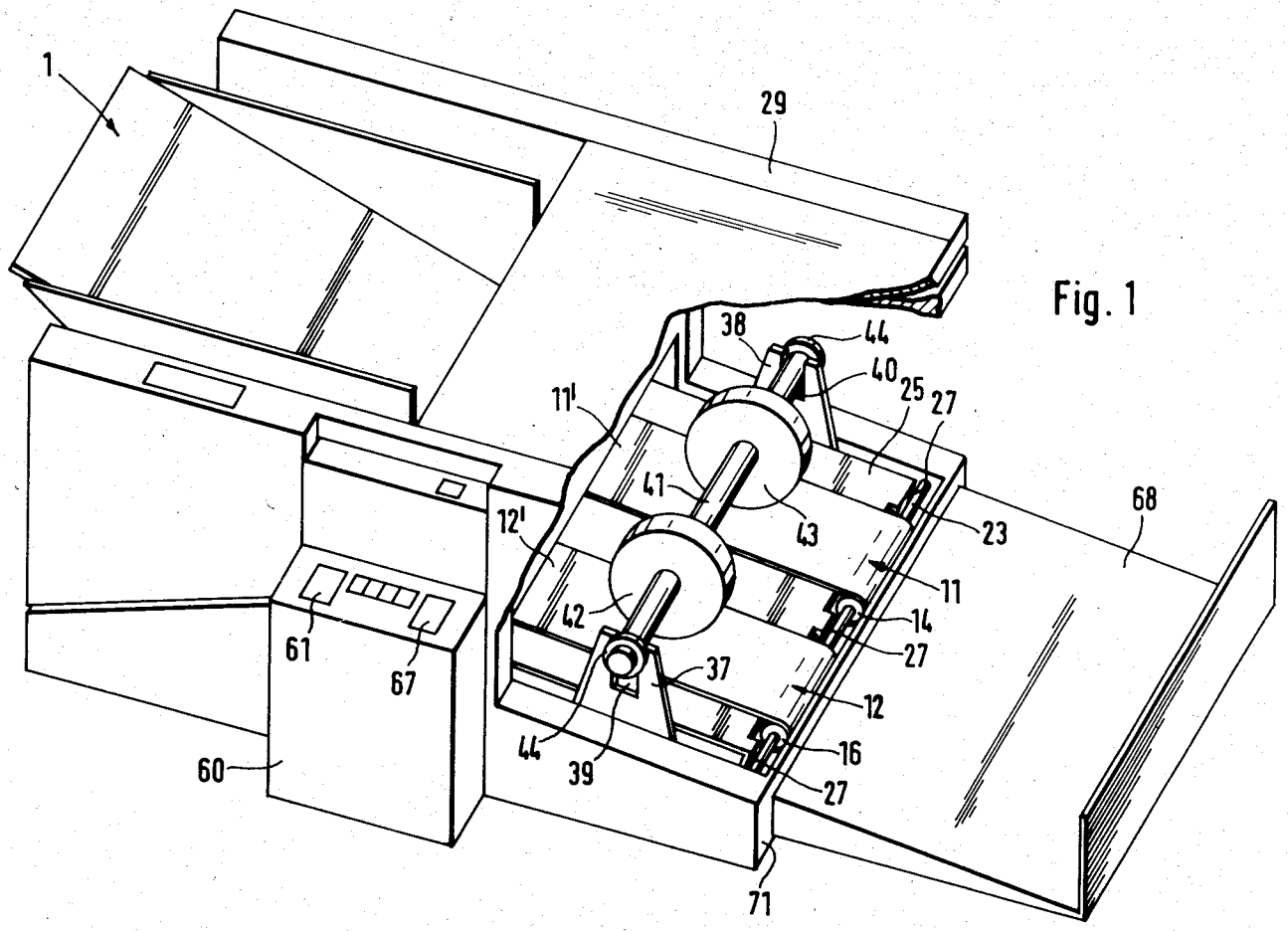
FIG. 1 is a top side perspective view of an upset folding machine constructed in accordance with the invention.
Figure 3:
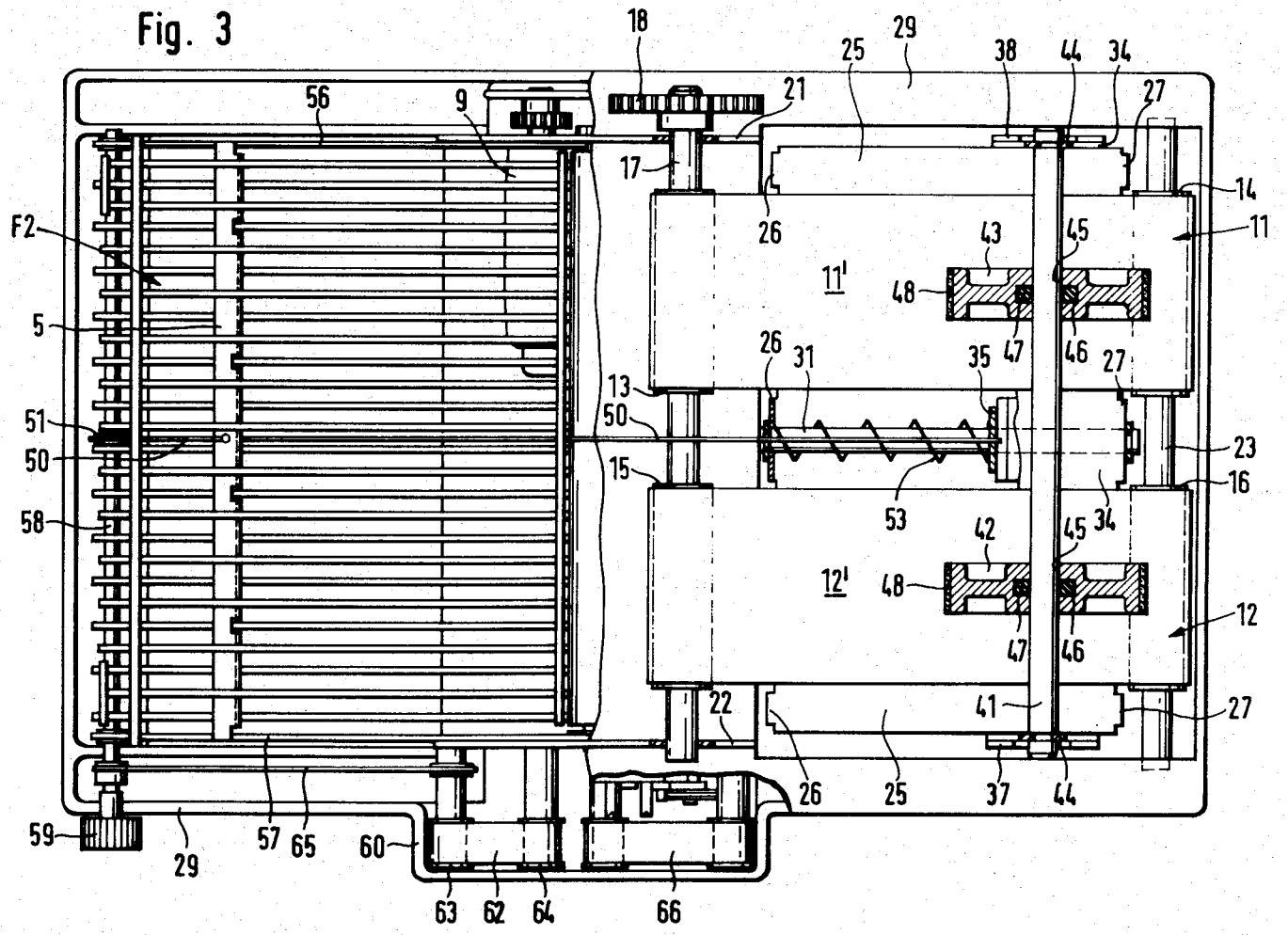
FIG. 3 is a section taken along the line III—III of FIG. 2.

The conveyor 4 comprises two conveyor belts 11 and 12 which, as is evident from FIGS. 1 and 3, are in spaced lateral relationship and led over band rollers 13, 14 and 15, 16, respectively. The band rollers 13 and 15 are jointly mounted on a drive shaft 17 which is in driving connection with a gear of the fold roll W4 via a gear 18, a pinion 19 and another gear 20 (FIG. 2) and which is rotatably mounted in two mounting plates 21 and 22 of the roll system 2. The two band rollers 14 and 16 are mounted jointly on an idler shaft 23. The upper stringers or reaches 11' and 12' of the conveyor belts 11 and 12 form jointly a transport path 24 inclined so as to drop to the outside in a transport direction due to the shafts 17 and 23 being mounted at different levels.

Between the belt rollers 13 and 15 and the belt rollers 14 and 16 there is, as supporting base for the upper stringers 11' and 12' of the conveyor belts 11 and 12, a table-like plate 25 which is fastened to a housing bottom 28 by means of angular brackets 26,27 disposed next to or between the conveyor belts 11 and 12. The housing bottom 28 forms part of a two-piece, fold-open complete housing 29 which completely encloses the two folding pockets F1 and F2 as well as the roll system 2, but has in the area of the conveyor an opening 30 which expands to the outside, making the conveyor 4 or the transport path 24 readily accessible from three sides. Fastened in the brackets 26 and 27 of the plate 25 which are located between the two conveyor belts 11 and 12 is a cylindrical guide rod 31 which extends parallel to the transport path 24 and on which is mounted, by means of a guide bushing 32, a holder 33 so as to be axially movable. This holder 33 consists of a flat part 34, which has two angular brackets 35 and 36 to accommodate the guide bushing 32, and it covers the entire width of the plate 25 and is provided at both ends with vertically extending supporting elements 37 and 38. These supporting elements 37 and 38 each have guide slots 39 and 40, respectively, which extend approximately perpendicular to the transport path 24 for the vertically movable accommodation of a shaft 41 on which are mounted, as brake elements, two cylindrical discs 42 and 43 resting loosely, i.e. only by their own weight, on the conveyor belts 11 and 12. The shaft 41 is guided in the guide slots 39 and 40 not only vertically movable, but also rotatably. In axial direction, it is secured against shifting by lock washers 44.

So that the two discs 42 and 43 can be mounted on the shaft 41 in a simple manner and also be both readily movable in axial direction on the shaft 41 and fixable in their respectively desired axial position, and so that synchronism between the two discs 42 and 43 is assured during the operation of the conveyor 4, the two discs 42 and 43 each have in their central hub bores 45 radial annular slots 46 in which are located O-rings 47 which consist of rubber or a similer elastic material and form a positive connection, i.e. a friction clutch, between the shaft 41 and the discs 42 and 43.

These two friction clutches serve the purpose of assuring synchronism between the two discs 42 and 43, and, at the same time, their axial movability on the shaft 41. Synchronism of the two discs 42 and 43 is of special importance for the correct alignment of the folded material. If this synchronism were not assured, there would be the danger of the folded material leaving the conveyor not parallel to the shaft 41, but obliquely thereto. In order to achieve adequately good friction between the folded material and the circumferential areas of the discs 42 and 43 as a precondition for assuring a correct aligning effect even for folded materials with smooth surface, the outside diameters of the discs 42 and 43 are each provided with a friction coating 48 which may consist of rubber or a similar material, for example.

It is also important for troublefree operation of the conveyor 4 that the distance of the two discs 42 and 43 or of the shaft 41 from the ejection point A formed by the ejection roll pair 7/8 correspond at least approximately to the length of the final folded material format, which is normally determined by the depth of the folding pocket F2 set by means of the paper stop 5. For this reason, the holder 33 is connected, by means of a flexible pulling member 50 in the form of a plastic wire, a string, or a chain, to the paper stop 5 of the folding pocket F2 comprising a rail. The pulling member 50 is led over an idler pulley 51 disposed at the lower end of the folding pocket F2 so that when the paper stop 5 is moved in the direction of arrow 52 to provide a greater folding pocket depth and, hence, a greater final folded material format, the distance of the shaft 41 of the conveyor 4 from the ejection point A is increased to the same extent, in this case due to the action of a compression spring 53 disposed on the guide rod 31 between the holder 33 and the bracket 36. Moving the paper stop 5 in the opposite direction, i.e. in the direction of arrow 54, results in a corresponding decrease of the distance between the shaft 41 and the ejection point A, which means a corresponding movement of the holder 33 in the direction of arrow 55. While it is basically immaterial how the paper stop 5 in the folding pocket F2 is moved, it is expedient and advantageous in the sense of simplifying the operation of the machine, if as provided in the embodiment example, both ends of the stop rail 5 are connected to toothed belts 56 and 57 running parallel to the folding pocket 2 next to it and drivable jointly in the sense of adjusting the paper stop 5 by a common drive shaft 58. For this purpose, the drive shaft 58 is provided with a knob 59 disposed outside of the housing 29. Instead of a fixed, straight-edge scale otherwise commonly used in such upfolding machines, a scale tape 62 is provided in the embodiment example in a housing projection 60 (FIG. 1) under a housing window 61, which tape is stretched over two rolls 63 and 64, communicating with the drive shaft 58 via a belt drive 65. For the exact setting of the paper stop 3 of the folding pocket F1 a second scale tape 66 is provided which is mounted and driven analogously and can be read through a second window 67 in the housing projection 60. So that the flow of the folded material on the transport path 24 will not be disturbed by the pulling member 50, its connection to the holder 33 is disposed below the transport path 24. For the rest, the pulling member 50 runs underneath the folding rolls W1 through W4 and the ejection rolls 7/8 above the drive shaft 17 through the roll system 2 and underneath the folding pocket F2 to the idler pulley 51. In addition, the pulling member 50 is kept taut constantly by the compression spring 53. From the conveyor belts 11 and 12 the folded pieces, seriated like scales by the conveyor 4, reach a delivery table 68 disposed below the transport path 24 on the lower housing face 71 (FIG. 1).

Figure 4:
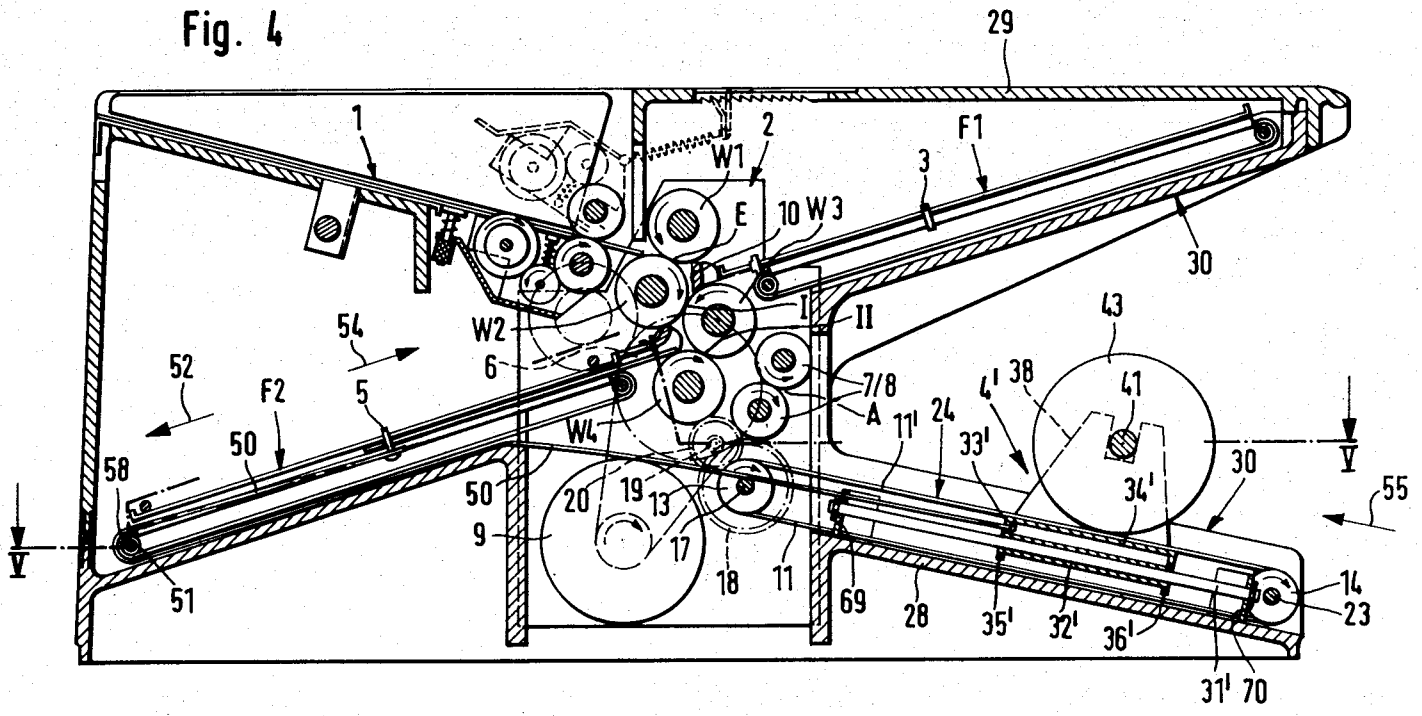
FIG. 4 is a sectional view similar to FIG. 2 of a different embodiment of the conveyor.
Figure 5:
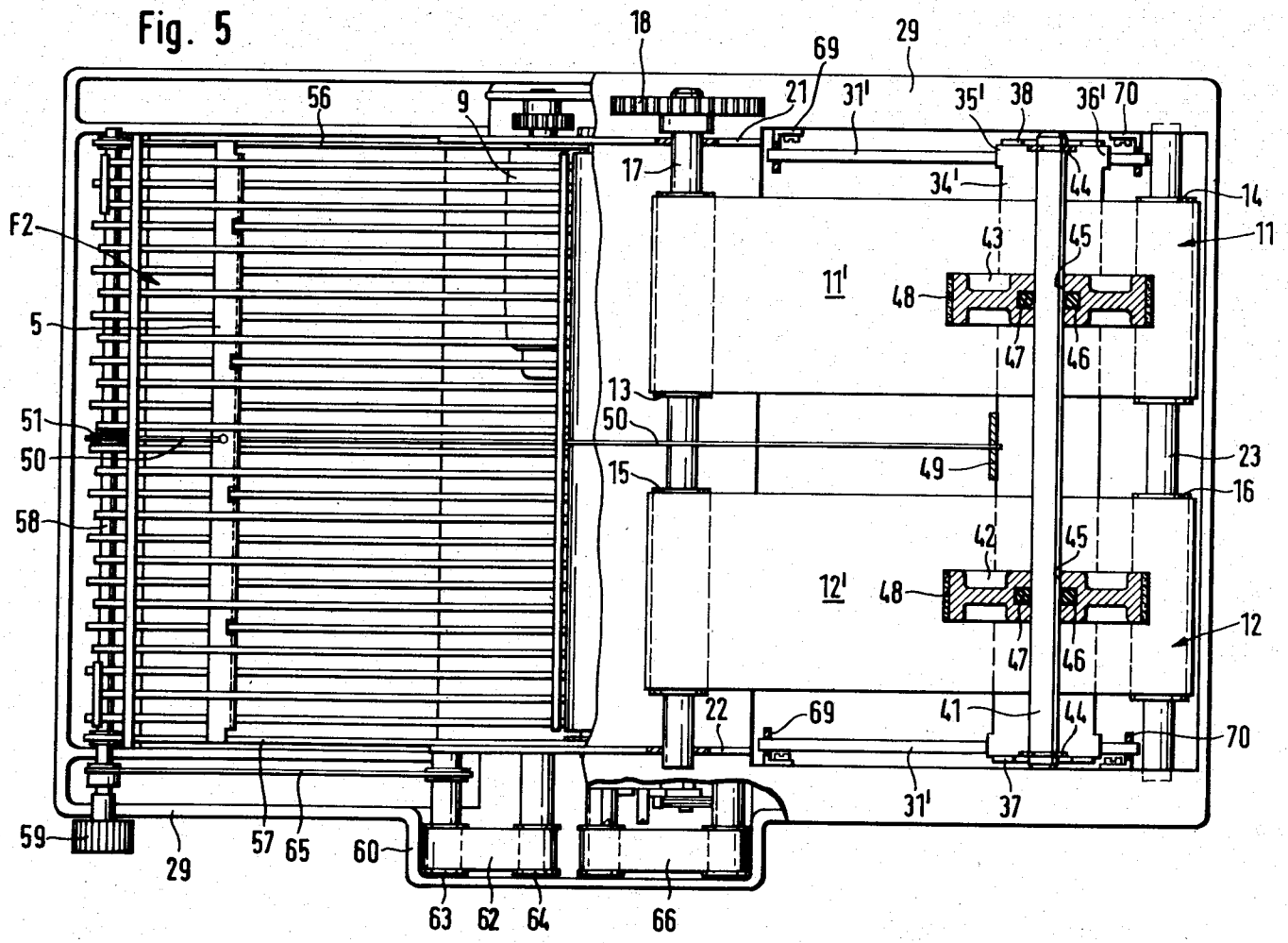
FIG. 5 is a section taken along the line V—V of FIG. 4.

In the embodiment example according to FIGS. 4 and 5, the table top 25 serving as supporting surface for the upper conveyor belt stringers 11' and 12' is missing. Instead, a flat part 34' of the holder 33' is disposed directly below the conveyor belt stringers 11' and 12', so that they glide over it, making contact with it, or are pushed to the surface of the flat part 34' by the weight of the discs 42 and 43 movable in vertical direction. At the outer ends of the flat part 34', the holder 33' is provided with brackets 35', 36' each bent downwardly at right angles and guided by means of a guide bushing 32' each in rails 31' disposed next to and parallel to the conveyor belts 11 and 12. The pulling member 50 is fastened in the same manner as in the embodiment example of FIGS. 1 through 3 to an angle 49 disposed on the flat part 34' between the two conveyor belts 11 and 12 and bent downwardly so that, in this embodiment too, an equally effective connection between the holder 33' and the paper stop 5 of the folding pocket F2 is established by the pulling member 50. The guide rails 31' are each fastened to the housing 29 by angular brackets 69 and 70. This embodiment requires no compression spring 53 because the pulling member 50 is kept taut constantly by the friction between the flat part 34' and the upper conveyor belt stringers 11' and 12' of the two conveyor belts 11 and 12, at least when the latter are revolving.

For the rest, this embodiment is identical with the one described above with reference to FIGS. 1 through 3. Its operating mode is the same also.

Figure 6:
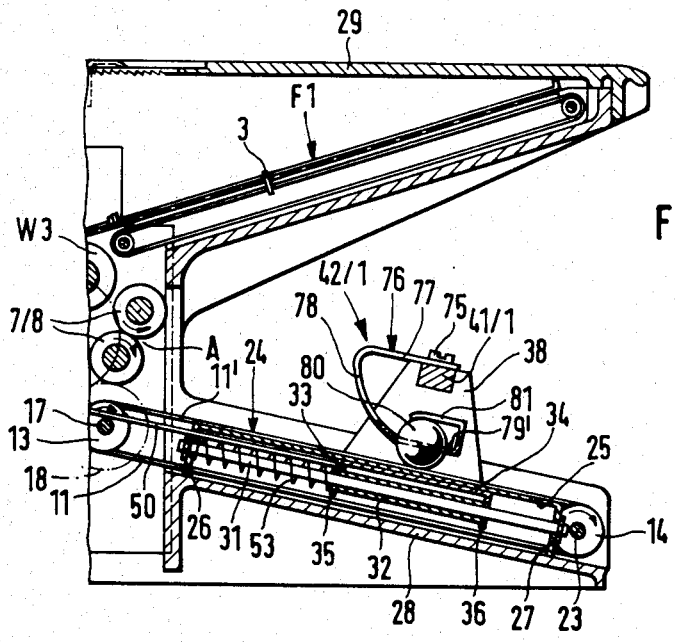
FIGS. 6 and 7 are partial sections similar to FIGS. 2 and 4 but with different conveyor brake elements.
Figure 7:
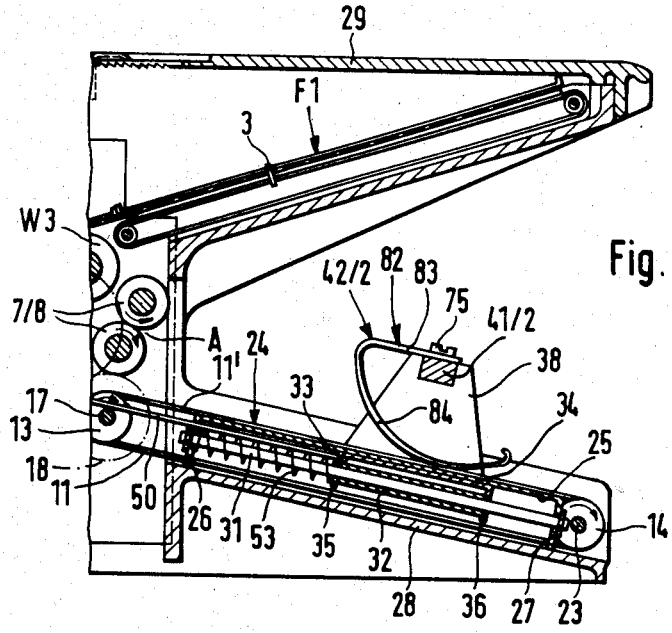

The embodiment examples depicted in the two FIGS. 6 and 7 correspond to the embodiment shown in FIGS. 1 through 3, except that in place of the discs 42 and 43 and of the shaft 41, other brake elements 42/1 and 42/2, respectively, are mounted to a nonrotating cross beam 41/1 and 41/2, respectively. The holder 33 is present in the same manner as in the embodiment example of FIGS. 1 through 3. Instead of the discs 42 and 43 there are fastened to the cross beam 41/1 by means of screws 75 two springs strip steel spring clips 76. Each one of these spring clips 76 has an upper, horizontal, straight section 77 resting on the cross beam 41/1 of rectangular section, followed by a section 78 which is bent downwardly roughly in circular arc shape and ultimately goes over into a section 79 extending roughly horizontal to the transport path 24 from which it is spaced a certain distance apart, with a circular breakthrough in which a metal ball 80 is mounted so it can turn freely. So that this metal ball 80 cannot jump upwardly out of this breakthrough 79', a terminal section 81 is bent in U shape to form something like a cage over the ball 80.

While the leading transverse edge of the folded material arriving from the ejection point A get directly under the discs 42 and 43 in the embodiments according to FIGS. 1 to 3 and 4,5, respectively, and is then pushed by said discs against the conveyor belts 11 and 12 or against the folded material already covering the conveyor belts, the folded material arriving from the ejection point A in the embodiment according to FIG. 6 gets analogously underneath the balls 80 which then assume the pushing function instead of the discs 42 and 43.

The situation is similar in the embodiment of FIG. 7, in which the brake elements 42/2 also consist of spring clips 82 which have no balls, however. The spring clips 82 are also made of spring strip steel and have an upper, straight section 83 which runs parallel to the transport path 24 and is fastened to the cross beam 41/2 by means of screws 75, followed by an arc-shaped section 84 which rests elastically on the conveyor belts 11 and 12 or on the folded material already covering them and pushes it against the conveyor belts.

It is clear that in the embodiments of FIGS. 6 and 7, where there are no synchronously running discs as pushing or braking elements, there is no synchronism effect either which can be utilized to align the folded material or drive the folded material uniformly over the entire width. Yet the holders 33 in these embodiments are also connected to the paper stop of the folding pocket F2 in the same manner by the pulling members 50 as in the embodiment examples of FIGS. 1 through 3 and 4,5 respectively, so that, here again, an automatic adjustment of of the brake elements or holders 33 is assured by the adjustment of the paper stop 5 in the folding pocket F2.

The seriation of the folded material leaving the ejection point A in scale-like fashion by the conveyor 4 is accomplished in all embodiment examples in that the conveyor belts 11 and 12 travel considerably more slowly than corresponds to the speed at which the folding material passes through the rolls W1 through W3 and in that the folded material, immediately upon leaving the ejection point A, is decelerated by the brake elements, i.e. by the discs 42 and 43 or by the spring clips 76 or 82 to the much slower transport speed of the conveyor belts 11 and 12. The folding speed may be as much as ten times greater than the transport speed of the conveyor belts 11 and 12 so that an edge spacing between the individual folded pieces of about 1 cm originates in their seriated succesion, which also depends on the original format and the final folded format, of course.

While specific embodimetns of the invention have been shown and described in detail to illustrate the application of the principles of the invention, it will be understood that the invention may b embodied otherwise without departing from such principles.

What is claimed is:

1. In a machine for folding a plurality of materials having means for feeding the materials to be folded in succession along a transport path, a plurality of folding devices arranged along the transport path including a folded material receiving pocket with an adjustable stop position to receive the materials at the location of the stop and for delivering the materials in the pocket to an ejection point, the improvement comprising a conveyor belt having a transport reach movable below the ejection point in a position to receive the folded materials, at least one brake element overlying said transport reach and resting on the folded materials moving thereon, mounting means associated with said brake element so that said brake element applies a yieldable pressure on the materials as they are moved, and a member connected to said mounting means and to the adjustable stop and being actuated by movement of the adjustable stop to move said mounting means by a corresponding amount in respect to said ejection point.

2. In a folding machine according to claim 1, wherein said member comprises a flexible member extending between said stop and said mounting means for said brake element, said folded material receiving pocket being located on one side of said ejection point and said conveyor belt transport reach being located on the opposite side of said ejection point means guiding said member between said stop on the folded material receiving pocket in said mounting means so that said mounting means is moved in an opposite direction in respect to the ejection point from the movement of the stop.

3. In a machine according to claim 1, wherein said mounting means comprises a plate over which said transport reach is movable, a support rod member extend along said conveyor, a support member engaged over said support rod member and being movable backwardly and forwardly therealong, said support member carrying an upright bracket on each end rotatably supporting a shaft, said brake element comprising a disc carried by said shaft.

4. In a folding machine according to claim 3 wherein said upright supports for said shaft includes an upwardly opening recess into which said shaft is positioned, said brake elements comprising rollers on said shaft, said shaft being supported with said rollers for upward and downward movement in accordance with the weight thereof bearing against the material being fed.

5. In a folding machine according to claim 1, wherein said brake element mounting means includes a flat plate disposed below said transport reach on which said transport reach is guided in an upstanding support plate at each side of said flat plate defining a receiving bearing, said brake elements comprising a shaft engaged in said receiving bearing carrying a roller engaged on the materials fed over said transport reach.

6. In a folding machine according to claim 1, wherein said mounting means comprises a holder mounted alongside said conveyor having a flat part disposed directly below said transport reach, and a guide rail on each side of said holder supporting said holder.

7. In a folding machine according to claim 1, wherein said member comprises a flexible member, an idler pulley arranged between said mounting means and said adjustable stop, said flexible member being guided around said pulley.

8. In a folding machine according to claim 1, wherein there are two separate laterally spaced conveyors, said brake elements comprising two laterally spaced cylindrical discs engaged over the transport reaches of each of said conveyors and a holder comprising said mounting means including upright support elements on each end having open top bearings, a shaft carrying said disc engaged in said open top bearings, said disc having peripheries with a friction coating.

9. In a folding machine according to claim 8, wherein said discs having a hub portion with bores, annular slot defined in each of said bores between the ends thereof, a friction element engaged on the periphery of said disc and riding in said slot forming a friction clutch for each of said discs providing a frictional clutch engagement.

10. In a folding machine according to claim 1, wherein said mounting means comprises an upright support member alongside said conveyor, said brake element including a resilient member carried by said support means bearing against the materials carried by said transport reach.

11. In a folding machine according to claim 10, wherein said resilient member includes a ball supported over said transport reach and rotatably engaging the materials on said reach.

* * * * *